US009122199B2

(12) United States Patent
Gyotoku

(10) Patent No.: US 9,122,199 B2
(45) Date of Patent: Sep. 1, 2015

(54) DEVELOPING DEVICE AND AN IMAGE FORMING APPARATUS INCLUDING THE SAME

(71) Applicant: KYOCERA Document Solutions Inc., Osaka (JP)

(72) Inventor: Eiji Gyotoku, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/459,199

(22) Filed: Aug. 13, 2014

(65) Prior Publication Data

US 2015/0078787 A1 Mar. 19, 2015

(30) Foreign Application Priority Data

Sep. 18, 2013 (JP) ..... 2013-192557

(51) Int. Cl.
*G03G 15/08* (2006.01)

(52) U.S. Cl.
CPC ..... *G03G 15/0849* (2013.01); *G03G 15/0856* (2013.01); *G03G 15/0893* (2013.01); *G03G 15/0889* (2013.01); *G03G 15/0891* (2013.01)

(58) Field of Classification Search
CPC ..... G03G 15/0889; G03G 15/0891
See application file for complete search history.

(56) References Cited

U.S. PATENT DOCUMENTS

2010/0124442 A1* 5/2010 Hatakeyama et al. ..... 399/254
2011/0243584 A1* 10/2011 Fukuda ..... 399/30

FOREIGN PATENT DOCUMENTS

JP 2005-242147 A 9/2005
JP 2005-345525 A 12/2005

* cited by examiner

*Primary Examiner* — Sandra Brase
(74) *Attorney, Agent, or Firm* — Stein IP, LLC

(57) ABSTRACT

A developing device includes a developing container, a first agitating feeding member, a second agitating feeding member, a first developer delivery portion, a second developer delivery portion, and a toner sensor. The developing container includes a first transport path and a second transport path. The first agitating feeding member and the second agitating feeding member agitate and feed developer. The first developer delivery portion delivers the developer from the first transport path to the second transport path. The second developer delivery portion delivers the developer from the second transport path to the first transport path. The toner sensor is disposed at a part of the first transport path near the first developer delivery portion. A ceiling height of a part of the first transport path facing the first developer delivery portion is larger than a ceiling height of other part of the first transport path.

9 Claims, 16 Drawing Sheets

DEVELOPING DEVICE AND AN IMAGE FORMING APPARATUS INCLUDING THE SAME

CROSS-REFERENCE TO RELATED APPLICATIONS

This application is based upon and claims the benefit of priority from the corresponding Japanese Patent Application No. 2013-192557, filed Sep. 18, 2013, the entire contents of which are incorporated herein by reference.

BACKGROUND OF THE INVENTION

The present disclosure relates to a developing device mounted in an image forming apparatus such as a copier, a facsimile, a printer, or the like, and the image forming apparatus including the same. In particular, the present disclosure relates to a developing device adapted to suppress aggregation and adhesion of developer and an image forming apparatus including the developing device.

Conventionally, as a developing method using dry toner in an image forming apparatus using an electrophotographic process, there are known a one-component developing method using one-component developer consisting of magnetic toner or non-magnetic toner and a two-component developing method using two-component developer for charging non-magnetic toner by magnetic carrier, in which a magnetic brush constituted of magnetic carrier and toner formed on a developing roller develops an electrostatic latent image on an image carrier (photoreceptor).

In the developing device described above, the toner is consumed by a developing operation. Therefore, a toner sensor for detecting toner density (or toner amount) is disposed in the developing device, and new toner is supplied in accordance with amount of toner consumed by developing. In this case, when charging amount of newly supplied toner is not sufficient, an image defect such as toner scattering or fog may occur. Therefore, in the two-component developing method, it is necessary to sufficiently agitate and mix the toner and the carrier so that the toner is charged to a predetermined charge amount. In addition, also in the one-component developing method, it is necessary to sufficiently mix the toner in the developing device with newly supplied toner so that charge amount distribution becomes uniform.

Therefore, there is a widely used method in which a circulation path of developer is disposed in the developing device, and an agitating feeding member having a screw shape constituted of a rotation shaft and a helical blade disposed in the circulation path agitates and mixes the developer so as to circulate and feed the same. Specifically, in a developing device 101 as illustrated in FIG. 18, an inside of a developing container 102 is divided into a first transport path 105 and a second transport path 107 by a partition wall 103. A first spiral 109 and a second spiral 110 for mixing, agitating, and feeding the developer are disposed in a rotatable manner in the first transport path 105 and in the second transport path 107.

Then, the developer is agitated and transported in an axis direction (directions of arrow A1 and arrow A2 in FIG. 18) by the first spiral 109 and the second spiral 110, and is circulated between the first transport path 105 and the second transport path 107 via developer delivery portions 111*a* and 111*b* formed on both ends of the partition wall 103. In other words, the first transport path 105, the second transport path 107, and the developer delivery portions 111*a* and 111*b* form the circulation path of the developer in the developing container 102.

Here, as higher image forming speed is required in recent years, it has become necessary to increase also a circulation speed (feed speed) of the developer in the developing device. As a method of increasing the feed speed of the developer, there is usually a method of increasing rotation speed of the first spiral 109 and the second spiral 110 illustrated in FIG. 18 and a method of increasing a pitch of the helical blade, for example.

SUMMARY OF THE INVENTION

A developing device according to an aspect of the present disclosure includes a developing container, a developer carrier, a first agitating feeding member, a second agitating feeding member, a first developer delivery portion, a second developer delivery portion, and a toner sensor. The developing container includes a first transport path and a second transport path disposed substantially in parallel to each other, and stores developer containing toner. The developer carrier is supported in a rotatable manner in the developing container and carries developer in the second transport path on its surface. The first agitating feeding member agitates and feeds the developer in the first transport path. The second agitating feeding member agitates and feeds the developer in the second transport path in the opposite direction to the first agitating feeding member. The first developer delivery portion passes the developer from the first transport path to the second transport path. The second developer delivery portion passes the developer from the second transport path to the first transport path. The toner sensor is disposed in a part near the first developer delivery portion in the first transport path so as to detect toner amount or toner density in the developing container. A ceiling height of a part of the first transport path opposed to the first developer delivery portion is larger than a ceiling height of other part of the first transport path.

Other objects of the present invention and specific advantages obtained from the present disclosure will become more apparent from the description of embodiments given below.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1:
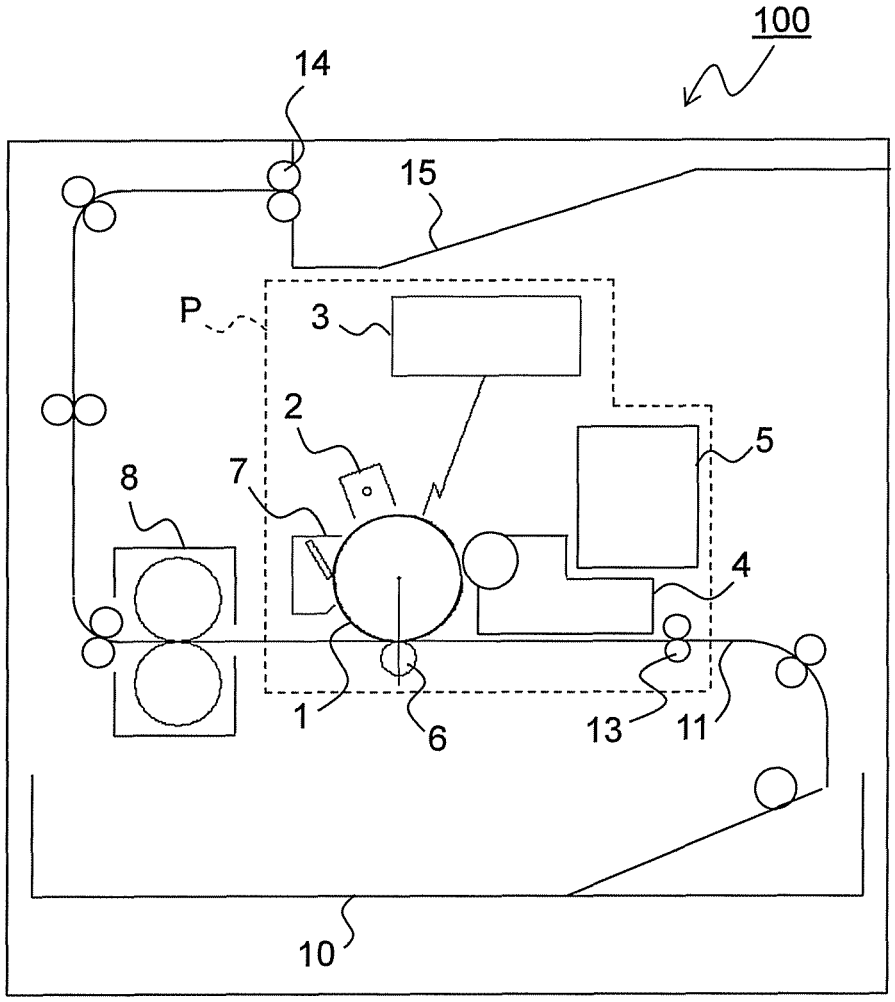
FIG. 1 is a schematic cross-sectional view illustrating an overall structure of an image forming apparatus including a developing device according to a first embodiment of the present disclosure.

Now, embodiments of the present disclosure are described with reference to the drawings.

First Embodiment

With reference to FIG. 1 to FIG. 7, a structure of an image forming apparatus 100 including a developing device 4 according to a first embodiment of the present disclosure is described. In the image forming apparatus (for example, a monochrome printer) 100, when performing an image forming operation, an image forming unit P in the apparatus main body forms an electrostatic latent image based on document image data transmitted from a personal computer (PC) (not shown), and the developing device 4 forms a toner image by adhesion of toner to the electrostatic latent image. The toner is supplied to the developing device 4 from a toner container 5. Further, in this image forming apparatus 100, a photoreceptor drum 1 is rotated in a clockwise direction in FIG. 1 while the image forming process is performed onto the photoreceptor drum 1.

The image forming unit P includes a charging unit 2, an exposing unit 3, the developing device 4, a transfer roller 6, a cleaning device 7, and a charge neutralizer (not shown), which are disposed along a rotation direction of the photoreceptor drum 1 (clockwise direction). The photoreceptor drum 1 includes, for example, an aluminum drum and a photosensitive layer laminated on the aluminum drum, and a surface thereof is charged by the charging unit 2. Then, the surface receives a laser beam from the exposing unit 3 described later so that an electrostatic latent image is formed with decreased charges. Note that the above-mentioned photosensitive layer is not particularly limited but is preferably, for example, an amorphous silicon (a-Si) layer superior in durability or an organic photosensitive layer (OPC) that generates little ozone in charging and can provide a high resolution image.

The charging unit 2 uniformly charges the surface of the photoreceptor drum 1. For instance, as the charging unit 2, a corona discharge device is used, which generates discharge by applying a high voltage to a thin wire or the like as an electrode. Note that instead of the corona discharge device, it is possible to use a contact type charging device that applies a voltage to a charging member such as a charging roller contacting with the photoreceptor surface. The exposing unit 3 irradiates the photoreceptor drum 1 with a light beam (for example, the laser beam) based on image data so as to form the electrostatic latent image on the surface of the photoreceptor drum 1.

The developing device 4 forms a toner image with toner adhered to the electrostatic latent image on the photoreceptor drum 1. Note that one-component magnetic developer (hereinafter also referred to simply as toner) including only magnetic toner component is stored in the developing device 4 in this example. In addition, a detailed structure of the developing device 4 will be described later. The transfer roller 6 correctly transfers the toner image formed on the surface of the photoreceptor drum 1 onto the paper sheet transported in a paper sheet transport path 11. The cleaning device 7 includes a cleaning roller or a cleaning blade that linearly contacts with the photoreceptor drum 1 in a longitudinal direction so as to remove residual toner remaining on the surface of the photoreceptor drum 1 after the toner image is transferred onto the paper sheet.

Further, the exposing unit 3 irradiates the photoreceptor drum 1 with the laser beam (light beam) based on the image data input in advance so that the electrostatic latent image based on the image data is formed on the surface of the photoreceptor drum 1. After that, the developing device 4 causes the toner to be adhered to the electrostatic latent image so that the toner image is formed.

As described above, the paper sheet is transported from a paper sheet storing unit 10 to the image forming unit P with the formed toner image via the paper sheet transport path 11 and a registration roller pair 13 at a predetermined timing. Then, in the image forming unit P, the toner image on the surface of the photoreceptor drum 1 is transferred onto the paper sheet by the transfer roller 6. Further, the paper sheet with the transferred toner image is separated from the photoreceptor drum 1 and is transported to a fixing unit 8 in which the paper sheet is heated and pressed so that the toner image is fixed to the paper sheet. The paper sheet after passing the fixing unit 8 passes a discharge roller pair 14 and is discharged onto a paper sheet discharge portion 15.

Figure 2:
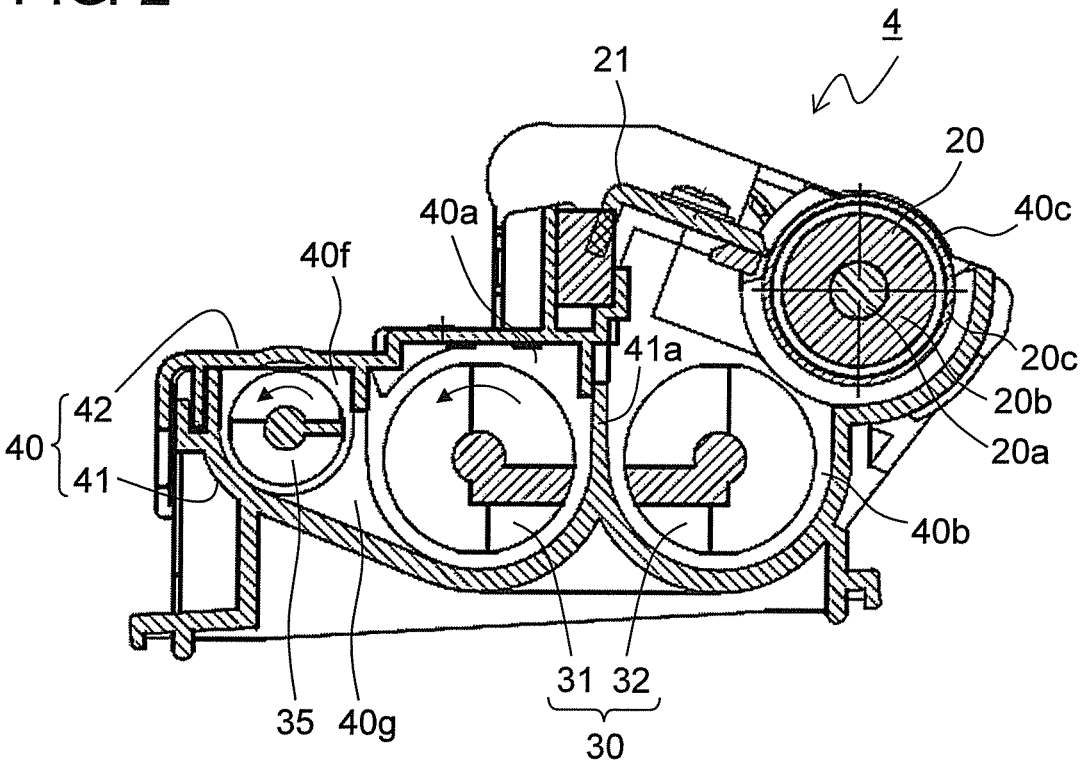
FIG. 2 is a side cross-sectional view illustrating a structure of the developing device according to the first embodiment of the present disclosure.

As illustrated in FIG. 2, the developing device 4 includes a developing roller (developer carrier) 20, a restricting blade 21, an agitating feeding member 30, a developer feeding member 35, and a developing container 40 housing these members. Note that FIG. 2 illustrates a state viewed from a rear side in FIG. 1, and a layout of the members in the developing device 4 is opposite to FIG. 1 in the left and right direction.

The developing container 40 forms an outer sheath of the developing device 4 and includes a main body 41 having an open upper surface and a cover member 42 that covers the upper surface of the main body 41. The developing container 40 is divided into a first transport path 40*a* and a second transport path 40*b* by a partition wall 41*a* formed in the main body 41. The first transport path 40*a* and the second transport path 40*b* store the one-component developer containing only the magnetic toner. In addition, the developing container 40 supports the agitating feeding member 30, the developer feeding member 35, and the developing roller 20 in a rotatable manner. Further, the developing container 40 is provided with an opening 40*c* that exposes the developing roller 20 to the photoreceptor drum 1 (see FIG. 1).

The developing roller 20 is disposed to be opposed to the photoreceptor drum 1 with a certain space. In addition, the developing roller 20 supplies the toner to the photoreceptor drum 1 in an opposing region close to the photoreceptor drum 1. The agitating feeding member 30 is disposed in a lower left of the developing roller 20. In addition, the restricting blade 21 is fixed and held by the developing container 40 at left of the developing roller 20.

The agitating feeding member 30 is constituted of a first spiral (first agitating feeding member) 31 and a second spiral (second agitating feeding member) 32. The second spiral 32 is disposed in the second transport path 40*b* at lower left of the developing roller 20, and the first spiral 31 is disposed in the first transport path 40*a* at left next to the second spiral 32.

The first and second spirals 31 and 32 agitate and feed the developer. In addition, developer delivery portions (a first developer delivery portion 40*d* and a second developer delivery portion 40*e* described later) are disposed on both ends in the longitudinal direction (perpendicular to the plane of FIG. 2) of the partition wall 41*a* separating between the first transport path 40*a* and the second transport path 40*b*. When the first spiral 31 rotates, the developer is transported from one of the developer delivery portions (first developer delivery portion 40*d*) formed in the partition wall 41*a* to the second spiral 32, and hence the developer circulates in the first transport path 40*a* and the second transport path 40*b*. Further, the developer is supplied from the second spiral 32 to the developing roller 20.

The developing roller 20 includes a fixed shaft 20*a*, a magnetic pole member 20*b*, and a developing sleeve 20*c* formed of a non-magnetic metal material in a cylindrical shape. The developing roller 20 is rotated in a clockwise direction in FIG. 2 by a drive mechanism (not shown) including a motor and gears.

When the developing sleeve 20*c* to which a developing bias is applied rotates, the developer (toner) carried on the surface of the developing sleeve 20*c* flies to the photoreceptor drum 1 due to a potential difference between a developing bias potential and a potential of the exposed part on the photoreceptor drum 1 in a developing region (opposing region between the developing roller 20 and the photoreceptor drum 1). The flying toner is sequentially adhered to the exposed part on the rotating photoreceptor drum 1, and hence the electrostatic latent image on the photoreceptor drum 1 is developed.

Figure 3:
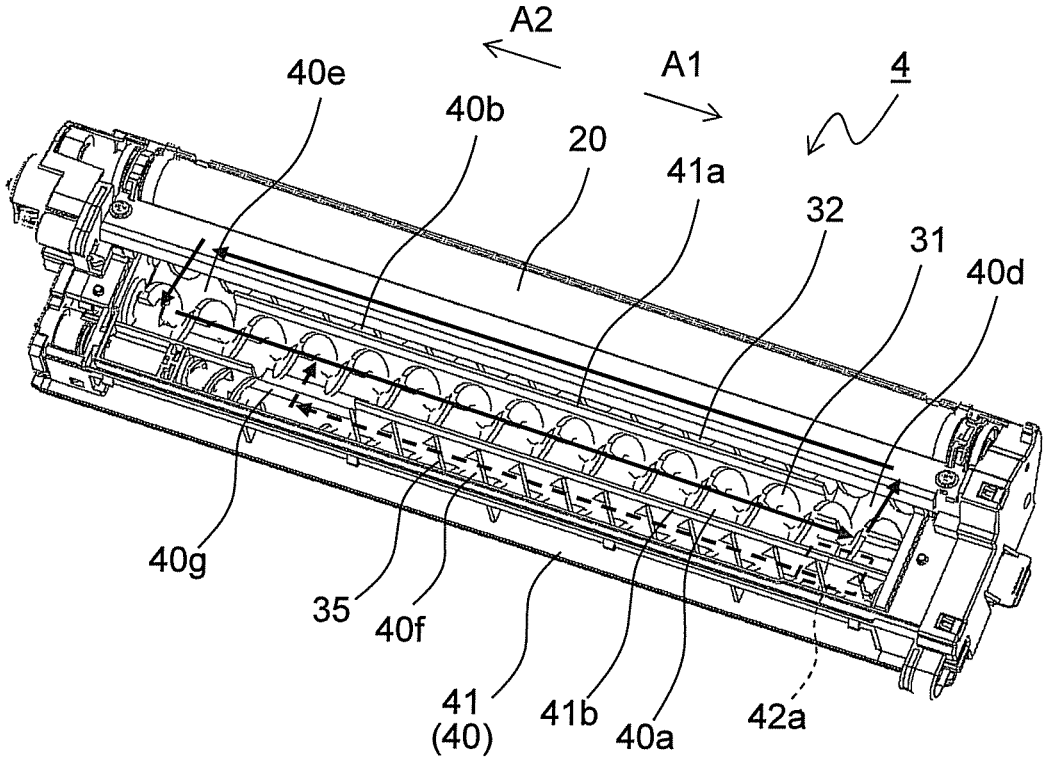
FIG. 3 is an external perspective view of the developing device in a state where a cover member is removed according to the first embodiment of the present disclosure.
Figure 4:
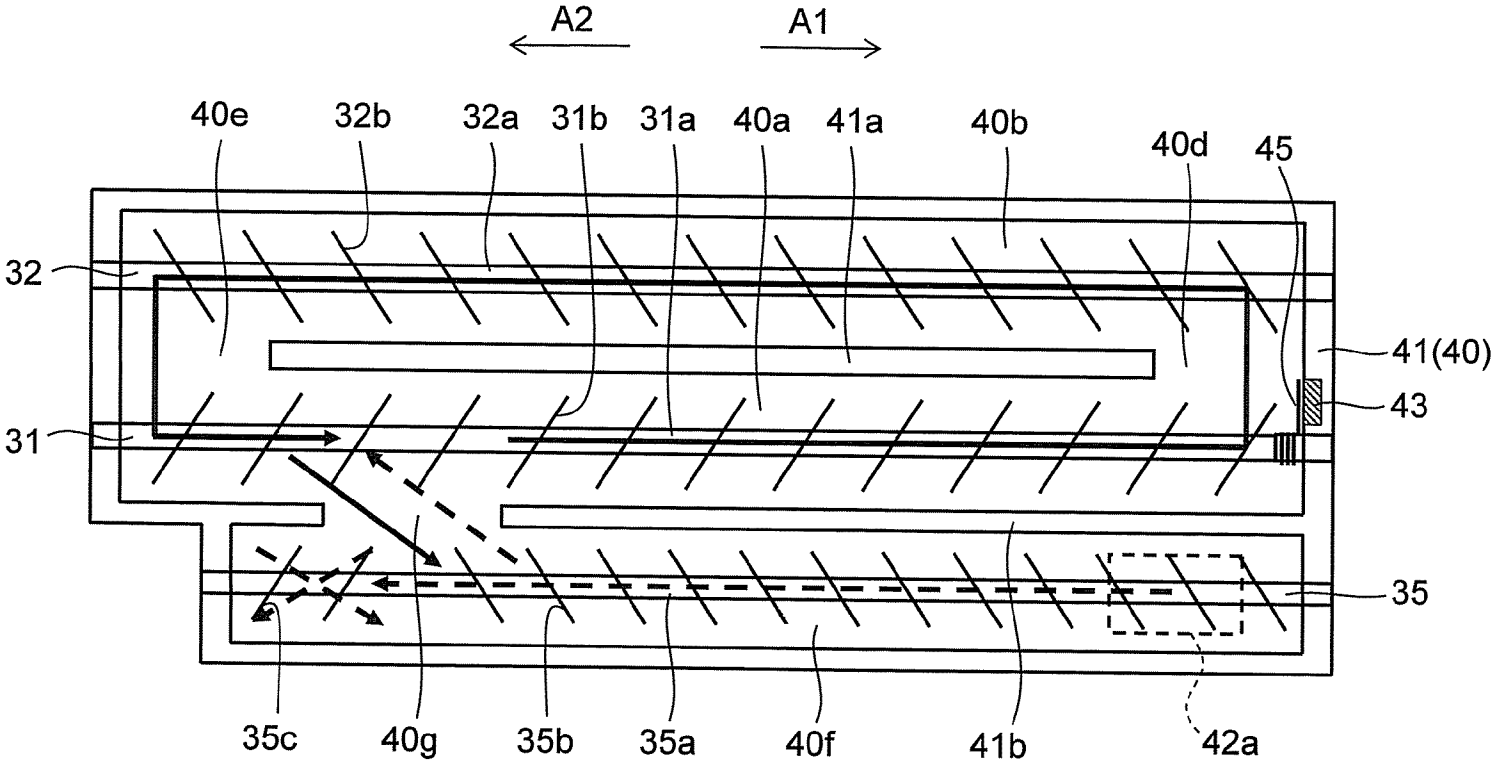
FIG. 4 is a plan cross-sectional view illustrating a structure of an agitating portion of the developing device according to the first embodiment of the present disclosure.

As illustrated in FIG. 3 and FIG. 4, the partition wall 41*a*, the first transport path 40*a*, the second transport path 40*b*, and the developer delivery portions 40*d* and 40*e* are formed in the developing container 40. In addition to them, a developer supply passage 40*f* is formed. This developer supply passage 40*f* is a passage for supplying new developer (supplied toner) from the toner container 5 to the first transport path 40*a*.

The first transport path 40*a*, the second transport path 40*b*, and the developer supply passage 40*f* are disposed in parallel to each other. The partition wall 41*a* extending in the longitudinal direction of the developing container 40 is disposed to separate between the first transport path 40*a* and the second transport path 40*b*. A partition wall 41*b* extending in the longitudinal direction of the developing container 40 is disposed to separate between the developer supply passage 40*f* and the first transport path 40*a*. Note that in the first transport path 40*a*, the left side of FIG. 3 is referred to as an upstream side, while the right side of FIG. 3 is referred to as a downstream side. In addition, in the second transport path 40*b*, the right side of FIG. 3 is referred to as an upstream side, while the left side of FIG. 3 is referred to as a downstream side.

The first developer delivery portion 40*d* and the second developer delivery portion 40*e* are formed on one side and on the other side in the longitudinal direction of the partition wall 41*a* (A1 direction side and A2 direction side). The first developer delivery portion 40*d* connects A1 direction ends of the first transport path 40*a* and the second transport path 40*b*. The second developer delivery portion 40*e* connects A2 direction ends of the first transport path 40*a* and the second transport path 40*b*. Then, the developer can circulates in the first transport path 40*a*, the first developer delivery portion 40*d*, the second transport path 40*b*, and the second developer delivery portion 40*e*.

A toner sensor 43 for detecting developer amount (toner amount) in the developing container 40 is disposed on an inner wall near the first developer delivery portion 40*d* of the first transport path 40*a*. As the toner sensor 43, a permeability sensor for detecting permeability of the toner (magnetic one-component developer) in the developing container 40 is used. The toner sensor 43 detects permeability of the toner and outputs a voltage value corresponding to the detection result to a control unit (not shown). The control unit determines toner remaining quantity from the output value of the sensor. Then, in accordance with the detection result of the toner sensor 43, the developer (toner) stored in the toner container 5 (see FIG. 1) is supplied to the developing container 40 via a supply port 42*a*. Note that as the toner sensor 43, it is also possible to use a piezoelectric sensor obtaining an electric signal when a pressure is applied to its detection surface besides the above-mentioned permeability sensor.

A rotation shaft 31*a* of the first spiral 31 is provided with a cleaning member 45 made of a spring material. When the first spiral 31 rotates, the cleaning member 45 also rotates so as to clean the detection surface of the toner sensor 43.

Figure 5:
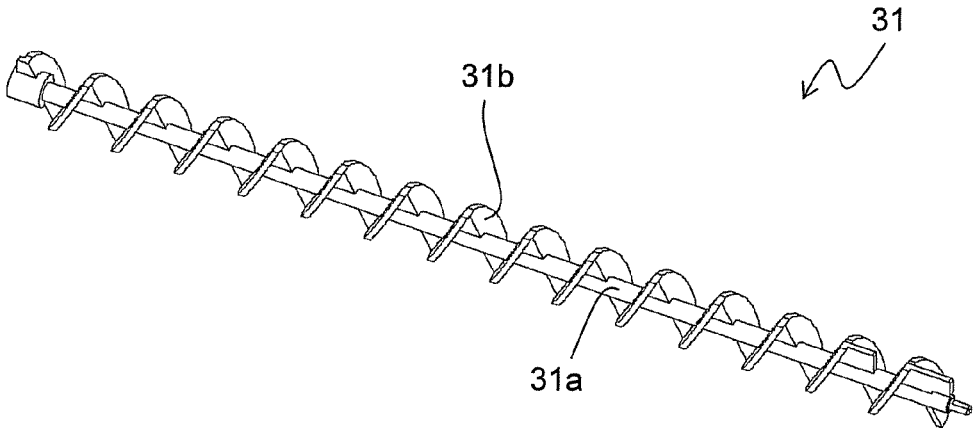
FIG. 5 is a perspective view illustrating a structure of a first spiral of the developing device according to the first embodiment of the present disclosure.

As illustrated in FIG. 3 to FIG. 5, the first spiral 31 includes the rotation shaft 31*a* pivoted to the developing container 40 in a rotatable manner, and a first helical blade (transporting blade) 31*b* having a substantially arc shape formed integrally with the rotation shaft 31*a* in a helical shape at a constant pitch in an axis direction of the rotation shaft 31*a*. The first helical blade 31*b* is designed to have thickness (length in the longitudinal direction) increasing from an outer edge part to the rotation shaft 31*a*, so as to agitate and feed the developer in the first transport path 40*a* in the A1 direction. The rotation shaft 31*a* and the first helical blade 31*b* are molded integrally using resin such as ABS resin to which the developer is hardly adhered.

As illustrated in FIG. 4, the second spiral 32 has the same structure as the first spiral 31 except for a different direction (phase) of the helical blade. In other words, the second spiral 32 includes a rotation shaft 32*a* and a second helical blade 32*b* that is formed integrally with the rotation shaft 32*a* in a helical shape at the same pitch as the first helical blade 31*b* in the axis direction of the rotation shaft 32*a* but in the opposite direction (opposite phase) to the first helical blade 31*b*. The rotation shaft 32*a* is disposed in parallel to the rotation shaft 31*a* and is pivoted to the developing container 40 in a rotatable manner. The second helical blade 32*b* agitates the developer in the second transport path 40*b* in the A2 direction (opposite to the A1 direction) and supplies the developer to the developing roller 20.

Figure 6:
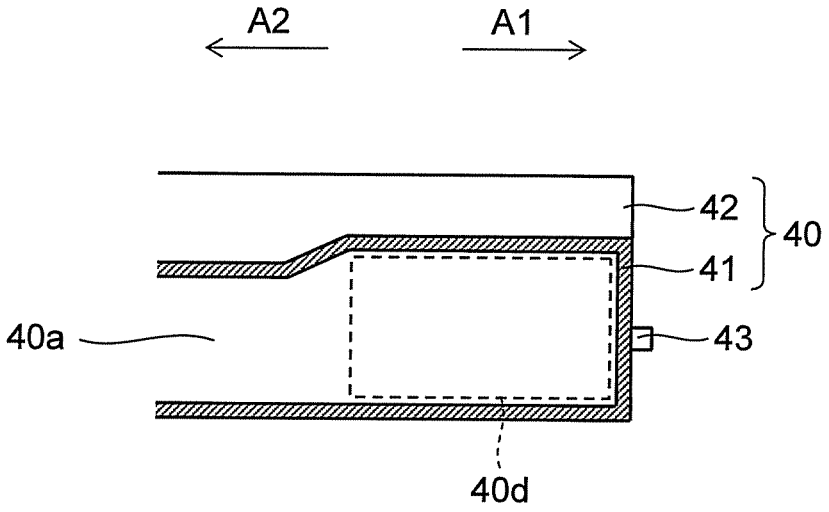
FIG. 6 is a cross-sectional view illustrating a structure around a first developer delivery portion of the developing device according to the first embodiment of the present disclosure.

As illustrated in FIG. 6, a distance between the main body 41 and the cover member 42 (hereinafter referred to as a ceiling height) at a part of the first transport path 40*a* facing the first developer delivery portion 40*d* is larger than a ceiling height of other part of the first transport path 40*a* (part other than the part facing the first developer delivery portion 40*d*). Note that as the ceiling height is larger, the developer hardly reaches the ceiling so that aggregation of the developer can be suppressed, though the developing container 40 becomes larger. Therefore, it is preferred to set the ceiling height at the part of the first transport path 40*a* facing the first developer delivery portion 40*d* to be larger than the ceiling height of other part of the first transport path 40*a* by approximately 8 mm to 15 mm.

As illustrated in FIG. 4, in a part of the developer supply passage 40*f* on the A1 direction side, the supply port 42*a* for supplying new developer (toner) to the developing container 40 from the toner container 5 disposed above the developing container 40 is formed in the cover member 42.

The developer supply passage 40*f* is a passage for transporting the developer supplied to a part on the A1 direction side to the A2 direction so as to supply the developer to the upstream side of the first transport path 40*a*. A supplying portion 40*g* for supplying the developer from the developer supply passage 40*f* to the first transport path 40*a* is formed in the developer supply passage 40*f*. The supplying portion 40*g* is formed on the upstream side (right side in FIG. 4) of the downstream side end (left end in FIG. 4) of the developer supply passage 40*f* in the developer transport direction (A2 direction) in the developer supply passage 40*f*, and on the downstream side (left side in FIG. 4) of the supply port 42*a*.

Figure 7:
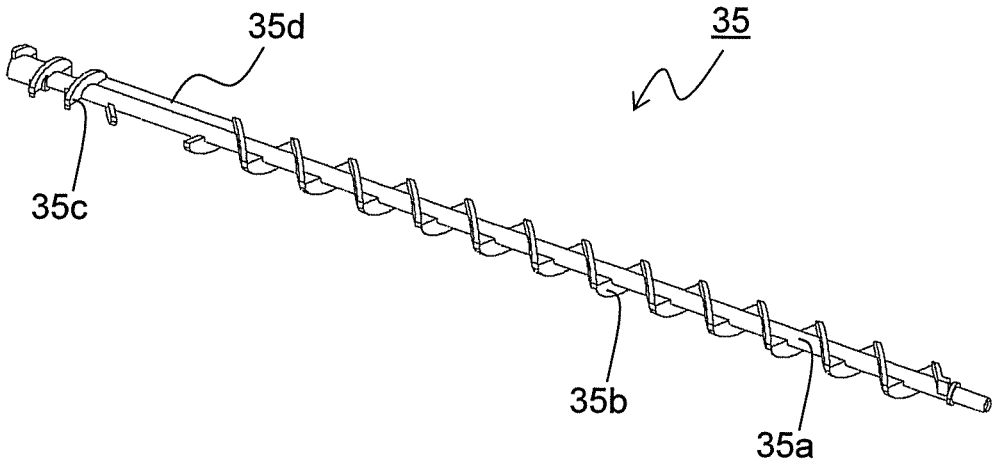
FIG. 7 is a perspective view illustrating a structure of a developer feeding member of the developing device according to the first embodiment of the present disclosure.

In the developer supply passage 40*f*, the developer feeding member 35 is disposed in parallel to the first spiral 31 and the second spiral 32. As illustrated in FIG. 3 and FIG. 7, the developer feeding member 35 includes a rotation shaft 35*a*, and a third helical blade 35*b* and a fourth helical blade 35*c* that are formed integrally with the rotation shaft 35*a*. The third helical blade 35*b* is formed in a helical shape of a blade having the opposite direction (opposite phase) to the first helical blade 31*b* in the axis direction of the rotation shaft 35*a*, and is formed from the supply port 42*a* (see FIG. 4) to the supplying portion 40*g*. The fourth helical blade 35*c* is formed in a helical shape of a blade having the opposite direction (opposite phase) to the third helical blade 35*b*, and is formed from the supplying portion 40*g* to the end on the A2 direction side. In addition, a transporting blade 35*d* having a paddle shape is formed in a part of the rotation shaft 35*a* facing the supplying portion 40*g*.

The developer feeding member 35 is configured to rotate in the same direction as the first spiral 31 (counterclockwise direction in FIG. 2), and hence the developer supplied to the supply port 42*a* is transported to the supplying portion 40*g* side. Because the third helical blade 35*b* and the fourth helical blade 35*c* have phases in opposite directions, the third helical blade 35*b* and the fourth helical blade 35*c* cause the developer to collide at the supplying portion 40*g* and to be transported to the first transport path 40*a*.

Note that the developer feeding member 35, the first spiral 31, and the second spiral 32 are driven to rotate by a drive mechanism (not shown) including a motor and gears.

In this embodiment, as described above, the ceiling height of the part of the first transport path 40*a* facing the first developer delivery portion 40*d* is larger than the ceiling height of other part of the first transport path 40*a*. In this way, it is possible to prevent the developer from reaching the ceiling in the part of the first transport path 40*a* near the first developer delivery portion 40*d*. Therefore, a bridge formation of the developer pressed by the pressure can be suppressed. Therefore, occurrence of an image defect such as fog due to collapse of a developer bridge can be suppressed. In addition, when the developer in the developing container 40 is decreased, it is possible to suppress false detection that there is sufficient developer when the toner sensor 43 detects a developer bridge.

Note that because a magnetic force or a rotation force of the developing roller 20 acts on the developer in the transport direction downstream end (left end in FIG. 4) of the second transport path 40*b*, stagnation of the developer hardly occur near the second developer delivery portion 40*e* for delivering the developer from the second transport path 40*b* to the first transport path 40*a*, and a developer bridge is hardly formed, too. Therefore, it is sufficient to increase the ceiling height only in the part of the first transport path 40*a* facing the first developer delivery portion 40*d*.

Second Embodiment

Figure 8:
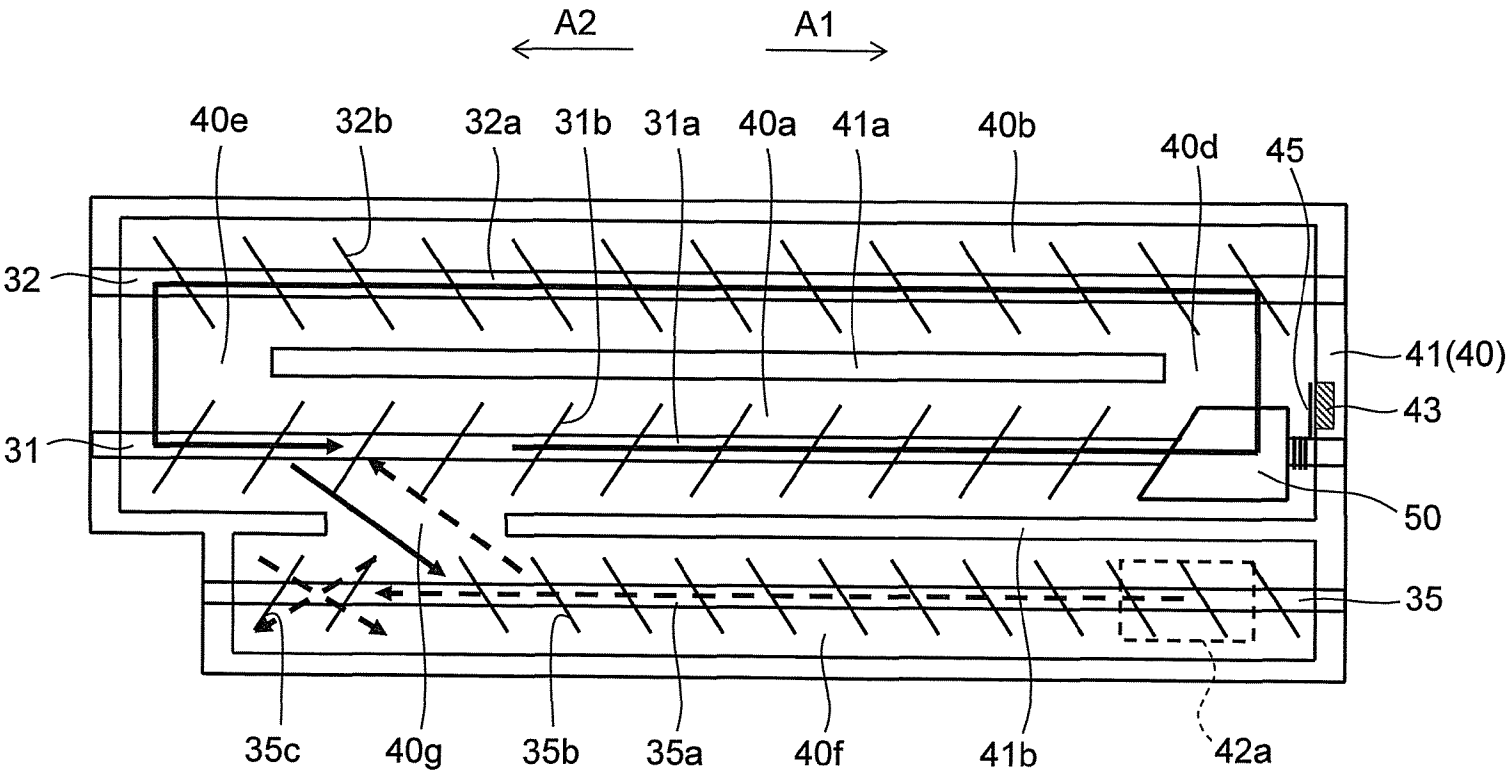
FIG. 8 is a plan cross-sectional view illustrating a structure of the agitating portion of the developing device according to a second embodiment of the present disclosure.
Figure 9:
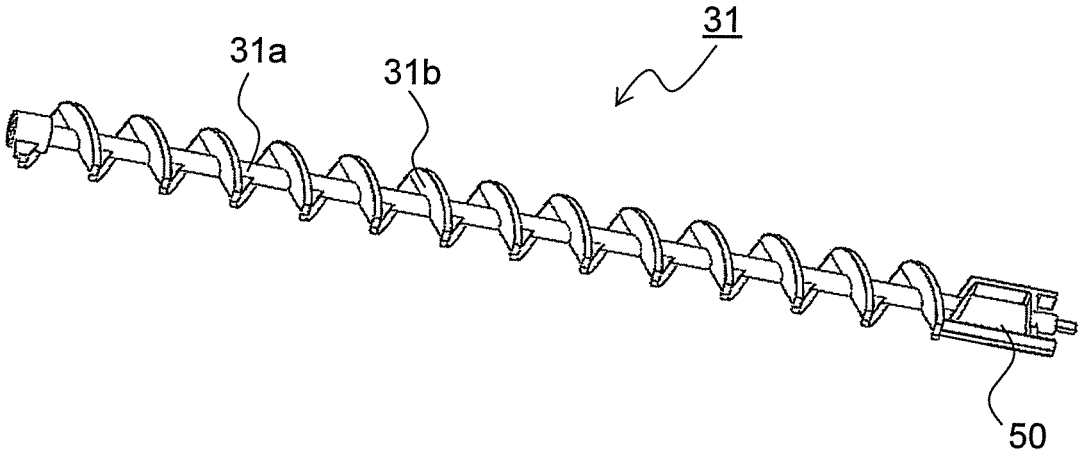
FIG. 9 is a perspective view of a structure of the first spiral of the developing device of the second embodiment of the present disclosure.
Figure 10:
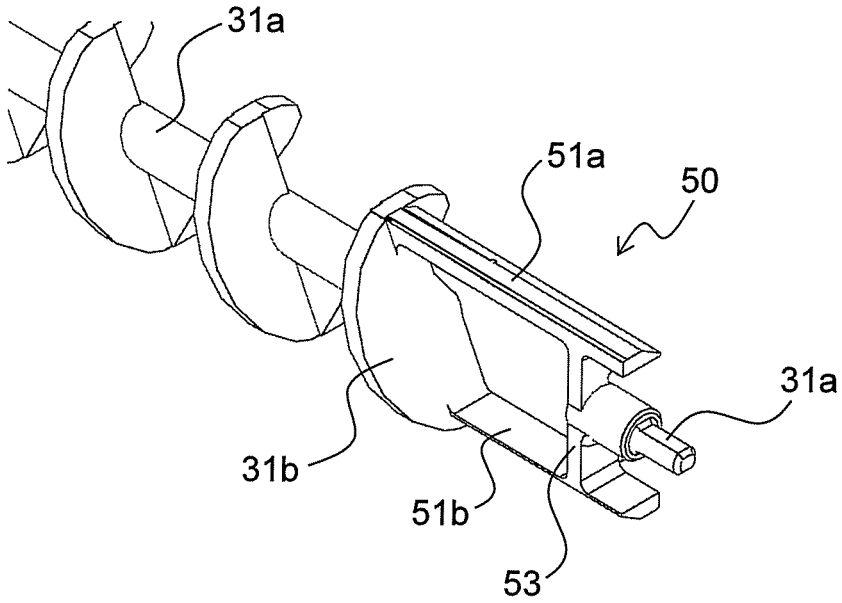
FIG. 10 is an enlarged perspective view illustrating a structure around a paddle portion of the first spiral of the developing device according to the second embodiment of the present disclosure.

Next, with reference to FIG. 8 to FIG. 10, the developing device 4 of the second embodiment of the present disclosure is described.

As illustrated in FIG. 8 and FIG. 9, the developing device 4 of the second embodiment of the present disclosure includes a paddle portion 50 having a frame-like shape without the rotation shaft 31*a* on the end of the first spiral 31 facing the first developer delivery portion 40*d* (downstream side end in the developer transport direction).

As illustrated in FIG. 10, the paddle portion 50 has a substantially rectangular shape in a plan view surrounded by the first helical blade 31*b* positioned at the most downstream side end in the developer transport direction, two first ribs 51*a* and 51*b* extending from the first helical blade 31*b* in parallel to the rotation shaft 31*a*, and a second rib 53 extending perpendicularly to the rotation shaft 31*a* to connect ends of the first ribs 51*a* and 51*b*. The second rib 53 is connected to the rotation shaft 31*a* on the surface opposite to the surface connected to the first ribs 51*a* and 51*b*. As illustrated in FIG. 8, the first helical blade 31*b* is formed so that a part thereof overlaps the first developer delivery portion 40*d* in the direction of the rotation shaft 31*a* (so as to exceed the end of the partition wall 41*a* and to protrude to the first developer delivery portion 40*d* side).

Other structure of the second embodiment is the same as the first embodiment described above.

In this embodiment, as described above, the part of the first spiral 31 facing the first developer delivery portion 40*d* is the part without the rotation shaft 31*a*, while the paddle portion 50 including the plurality of first ribs 51*a* and 51*b* parallel to the rotation shaft 31*a* is formed. In this way, because sufficient space is secured in a vicinity of the first ribs 51*a* and 51*b*, even if the developer is deteriorated so that fluidity is lowered, the developer can pass the space between the first ribs 51*a* and 51*b* so as to circulate, and adhesion of the developer to the first ribs 51*a* and 51*b* and to the ceiling of the developing container 40 can be suppressed more.

In addition, because the paddle portion 50 is formed using the first helical blade 31*b* positioned on the most downstream side in the developer transport direction as described above, the developer can be efficiently transported to the paddle portion 50 without attenuating a driving force (transporting force) of the first helical blade 31*b* in the direction of the rotation shaft 31*a*.

In addition, as described above, the paddle portion 50 has a frame-like shape surrounded by the first helical blade 31*b*, the two first ribs 51*a* and 51*b* extending from the first helical blade 31*b* in parallel to the rotation shaft 31*a*, and the second rib 53 extending perpendicularly to the rotation shaft 31*a* to connect the ends of the first ribs 51*a* and 51*b*. The second rib 53 is connected to the rotation shaft 31*a* on the surface opposite to the surface connected to the first ribs 51*a* and 51*b*. In this way, the part without the rotation shaft 31*a* (paddle portion 50) can be easily provided to the first spiral 31, and strength of the paddle portion 50 can be easily secured.

In addition, as described above, at least a part of the first helical blade 31*b* on the most downstream side in the developer transport direction is formed to overlap the first developer delivery portion 40*d* in the direction of the rotation shaft 31*a*. In this way, the developer can be smoothly moved from the first transport path 40*a* to the second transport path 40*b* in the first developer delivery portion 40*d*.

Other effects of the second embodiment are the same as those of the first embodiment described above.

Third Embodiment

Figure 11:
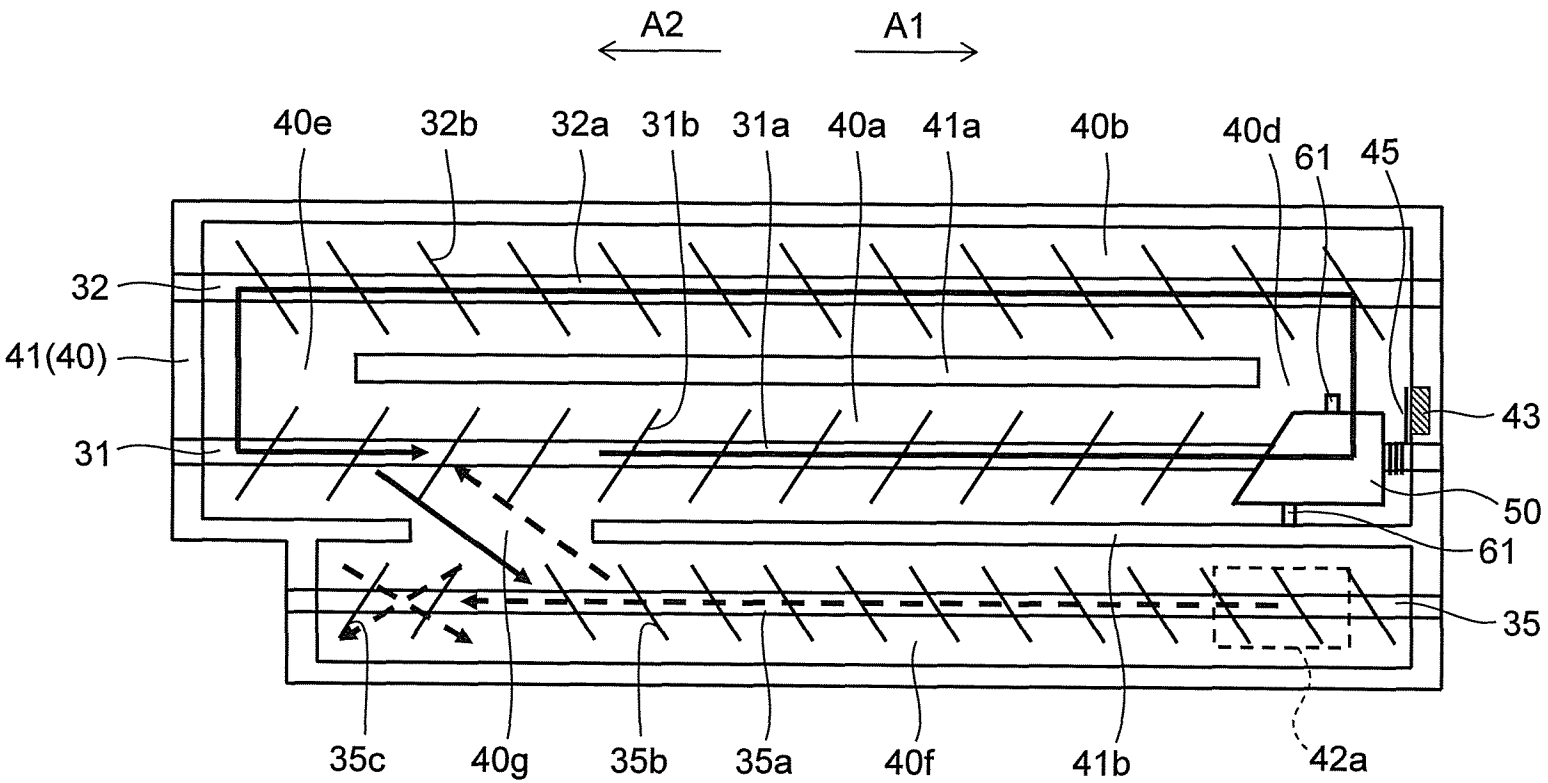
FIG. 11 is a plan cross-sectional view illustrating a structure of the agitating portion of the developing device according to a third embodiment of the present disclosure.
Figure 12:
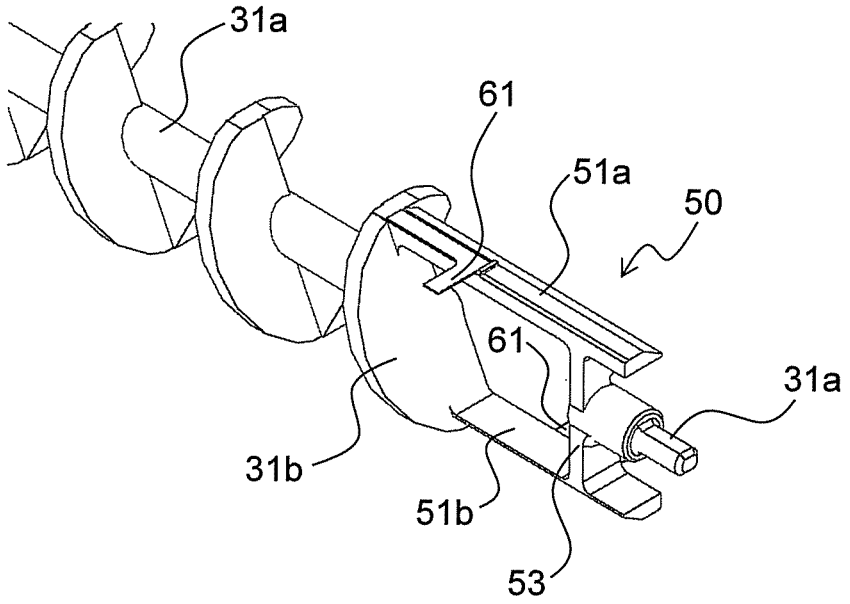
FIG. 12 is an enlarged perspective view illustrating a structure around the paddle portion of the first spiral of the developing device according to the third embodiment of the present disclosure.
Figure 13:
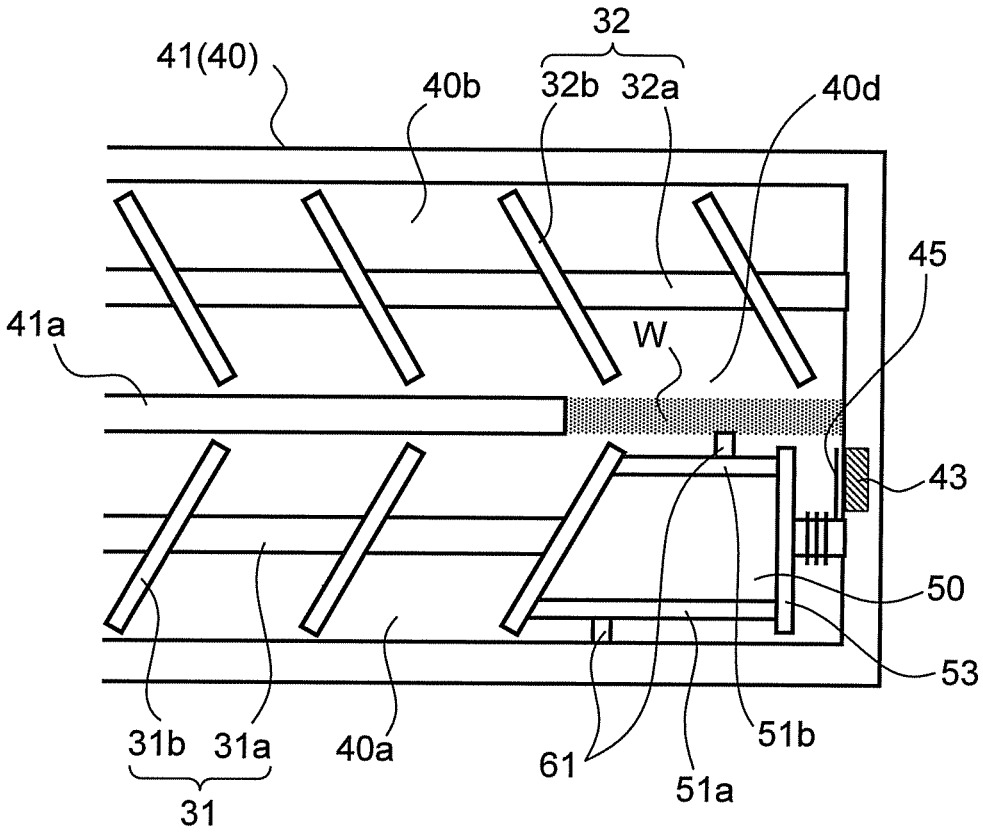
FIG. 13 is a plan cross-sectional view illustrating a structure around the first developer delivery portion of the developing device according to the third embodiment of the present disclosure.

Next, with reference to FIG. 11 to FIG. 13, the developing device 4 of a third embodiment of the present disclosure is described.

As illustrated in FIG. 11, in the developing device 4 of the third embodiment of the present disclosure, the paddle portion 50 of the first spiral 31 is equipped with a developer breaking member 61 for breaking the developer wall formed in the first developer delivery portion 40*d*.

As illustrated in FIG. 12, the developer breaking member 61 is disposed on each of outer surfaces of the first ribs 51*a* and 51*b*. The developer breaking members 61 are disposed at different protruding positions in the direction of the rotation shaft 31*a* of the first spiral 31. Distal ends of the developer breaking members 61 protrude in the rotation direction of the first spiral 31 (tangential direction of rotation locus of the first ribs 51*a* and 51*b*). When the first spiral 31 rotates, the developer breaking members 61 rotate while the distal ends thereof contact and slide on the inner wall of the first transport path 40*a*. When the first rib 51*a* or 51*b* approaches the developer delivery portion 40*d*, the distal end of the developer breaking member 61 reaches the first developer delivery portion 40*d* so as to contact with a developer wall W formed in the first developer delivery portion 40*d* (hatching part in FIG. 13).

When the first spiral 31 rotates around the rotation shaft 31*a*, a driving force in the axis direction is generated in the spiral part of the first spiral 31 (region in which the first helical blade 31*b* is formed), and hence the developer is transported in the A1 direction in the first transport path 40*a*. In the part facing the first developer delivery portion 40*d*, when the first spiral 31 rotates, the paddle portion 50 also rotates. Then, the rotation of the first ribs 51*a* and 51*b* causes the developer to be fed to the second transport path 40*b* via the first developer delivery portion 40*d*. In addition, in the first developer delivery portion 40*d*, the developer is delivered to the second transport path 40*b* by momentum when the developer on the upstream side is transported.

However, the first developer delivery portion 40*d* has a region where the transporting force of the first spiral 31 and the second spiral 32 do not act. In particular, when the developer amount in the developing container 40 is small, pressure of the developer sent out from the first transport path 40*a* also becomes small. Therefore, the developer is deposited in the first developer delivery portion 40*d* so that the developer wall W is formed to block the first developer delivery portion 40*d* as illustrated in FIG. 13. As a result, the developer stagnates in the vicinity of the upstream side of the first developer delivery portion 40*d* so that the output value of the toner sensor 43 is increased.

On the other hand, when a predetermined amount of or more developer stagnates in a vicinity of the upstream side of the first developer delivery portion 40*d*, the stagnated developer presses the developer wall W formed in the first developer delivery portion 40*d* to collapse. As a result, the developer amount in the vicinity of the upstream side of the first developer delivery portion 40*d* is rapidly decreased so that the output value of the toner sensor 43 is decreased. This phenomenon is repeated so that the output value of the toner sensor 43 becomes unstable.

Therefore, in this embodiment, the developer breaking members 61 provided to the first ribs 51*a* and 51*b* of the paddle portion 50 are used for breaking the developer wall W in the first developer delivery portion 40*d*, and hence the developer does not stagnate in the vicinity of the upstream side of the first developer delivery portion 40*d*. In this way, even if the developer amount in the developing container 40 is small, or the developer is deteriorated so that its fluidity is lowered, the output value of the toner sensor 43 can be stabilized. In addition, control accuracy of toner supply from the toner container 5 to the developing device 4 is also improved.

As a material of the developer breaking member 61, it is preferred to use a resin film such as a PET film that can be elastically deformed. In addition, as a width of the developer breaking member 61 (size in the direction of the rotation shaft 31*a*) becomes larger, the effect of breaking the developer wall W becomes larger. However, because the developer adhered to the developer breaking member 61 is also increased, the developer adhered to the developer breaking member 61 may cause false detection of the toner sensor 43. Therefore, it is preferred that the width of the developer breaking member 61 be approximately 1 mm to 10 mm. In addition, in order to effectively break the developer wall W in the first developer delivery portion 40*d*, it is necessary to set a protruding amount of the developer breaking member 61 (size in the rotation direction) so that the distal end of the developer breaking member 61 protrudes outside in a radial direction from the rotation locus of the first helical blade 31*b*.

In addition, when the developer breaking member 61 is disposed in a vicinity of the detection surface of the toner sensor 43, the toner adhered to the developer breaking member 61 may be detected by the toner sensor 43, and hence the output of the sensor is badly affected. Therefore, it is necessary to dispose the developer breaking member 61 outside a detectable region of the toner sensor 43 in a depth direction of the developing container 40 (left direction in FIG. 13) with respect to the detection surface of the toner sensor 43.

Other structure of third embodiment is the same as in the second embodiment described above.

In this embodiment, as described above, the first ribs 51*a* and 51*b* of the paddle portion 50 are provided with the developer breaking member 61 for breaking the developer wall W. In this way, it is possible to prevent the developer from stagnating in a vicinity of the upstream side of the first developer delivery portion 40*d*. Therefore, even if the developer amount in the developing container 40 is small, or the developer is deteriorated so that its fluidity is lowered, the output value of the toner sensor 43 can be stabilized. In addition, control accuracy of toner supply from the toner container 5 to the developing device 4 is more improved.

In addition, as described above, the developer breaking member 61 protrudes outside in the radial direction from the rotation locus of the first helical blade 31*b* of the first spiral 31. In this way, the developer wall W formed in a region that is not affected by the transporting forces of the first spiral 31 and the second spiral 32 can be easily broken by the developer breaking member 61.

In addition, as described above, the developer breaking member 61 is provided to the plurality of first ribs 51*a* and 51*b* at different positions in the direction of the rotation shaft 31*a*. In this way, the developer wall W can be effectively broken.

In addition, as described above, the developer breaking member 61 is disposed at a position such as not to contact with the detection surface of the toner sensor 43. In this way, it is possible to prevent the toner sensor 43 from detecting the toner adhered to the developer breaking member 61.

Other effects of the third embodiment are the same as those of the second embodiment described above.

Next, supporting experiment that was performed for confirming the effects of the first embodiment and the second embodiment is described.

This supporting experiment was performed for Example 1 corresponding to the first embodiment, Example 2 corresponding to the second embodiment, and Comparative Example 1 that does not correspond to the embodiments.

In Example 1, the developing device 4 corresponding to the first embodiment was used. In other words, the ceiling height of the part of the first transport path 40*a* facing the first developer delivery portion 40*d* was set larger than the ceiling height of other part of the first transport path 40*a* by 10 mm. The first spiral 31 without the paddle portion 50 was used.

In addition, a diameter and a pitch of the helical blade of the first spiral 31 and the second spiral 32 were 20 mm and 20 mm, respectively, and a rotational frequency was 34.5 rpm. Opening widths of the developer delivery portions 40*d* and 40*e* were 31 mm, and a gap between the developing container 40 and the first spiral 31 as well as the second spiral 32 was 1.5 mm. A circumference speed ratio (S/D) of the developing roller 20 to the photoreceptor drum 1 was 1.41. As to conditions of applying voltage to the developing roller 20, Vpp was 1,600 V, a duty ratio was 45%, a frequency was 2.7 kHz, and Vdc (DC component) was 290 V. The developer (toner) having average mean grain diameter of 6.8 μm was used.

In Example 2, the developing device 4 corresponding to the second embodiment was used. In other words, the first spiral 31 with the paddle portion 50 was used. Other structure of Example 2 was the same as in Example 1.

Figure 14:
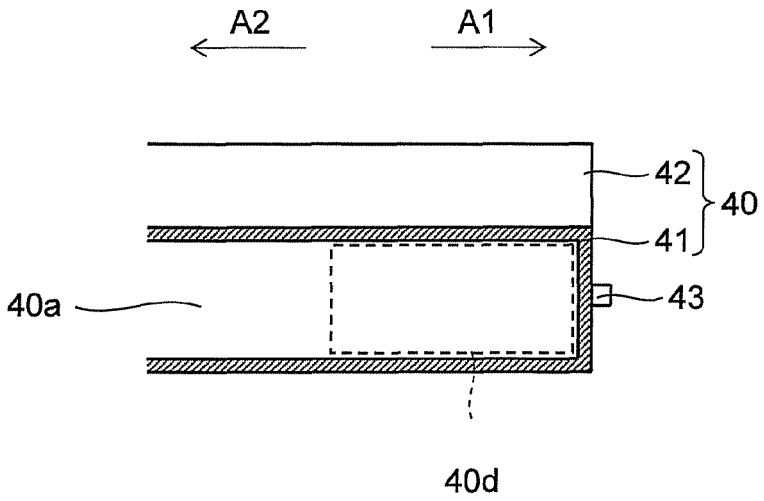
FIG. 14 is a cross-sectional view illustrating a structure around the first developer delivery portion of the developing device according to Comparative Example 1.

In Comparative Example 1, as illustrated in FIG. 14, unlike Examples 1 and 2, the ceiling height of the part of the first transport path 40*a* facing the first developer delivery portion 40*d* was the same as the ceiling height of other part of the first transport path 40*a*. The first spiral 31 without the paddle portion 50 was used. Other structure of Comparative Example 1 was the same as Example 1.

Figure 16:
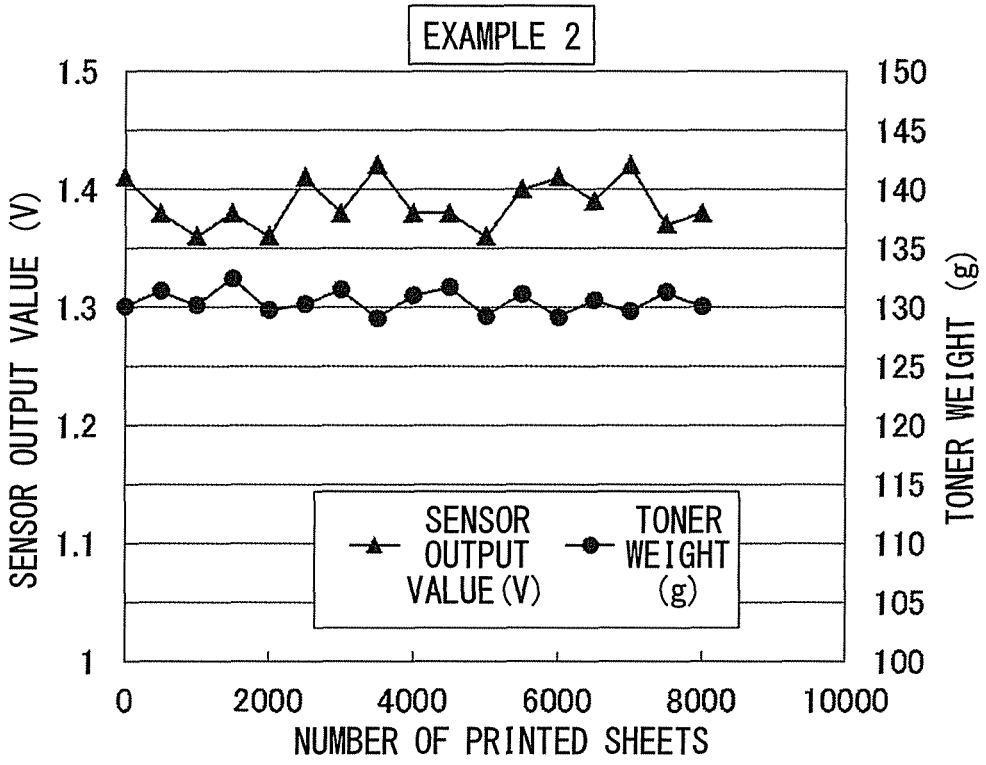
FIG. 16 is a graph showing a result of measuring the sensor output value (V) and the toner weight (g) every 500 sheet printing when continuous printing is performed using the developing device of Example 2.
Figure 17:
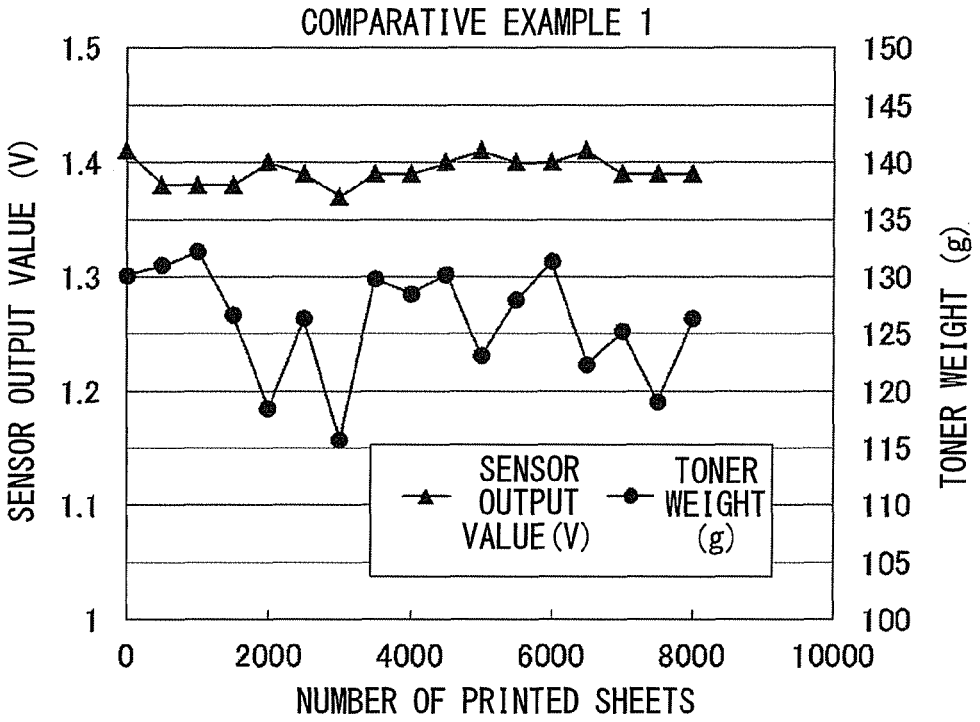
FIG. 17 is a graph showing a result of measuring the sensor output value (V) and the toner weight (g) every 500 sheet printing when continuous printing is performed using the developing device Comparative Example 1.
Figure 18:
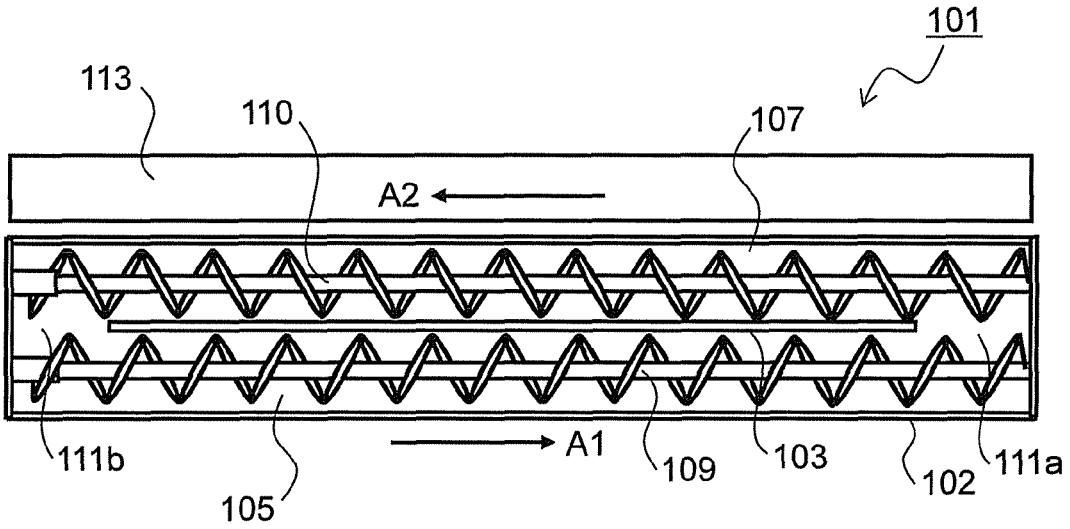
FIG. 18 PRIOR ART
FIG. 18 is a plan cross-sectional view illustrating an example of a conventional developing device.
Figure 18:
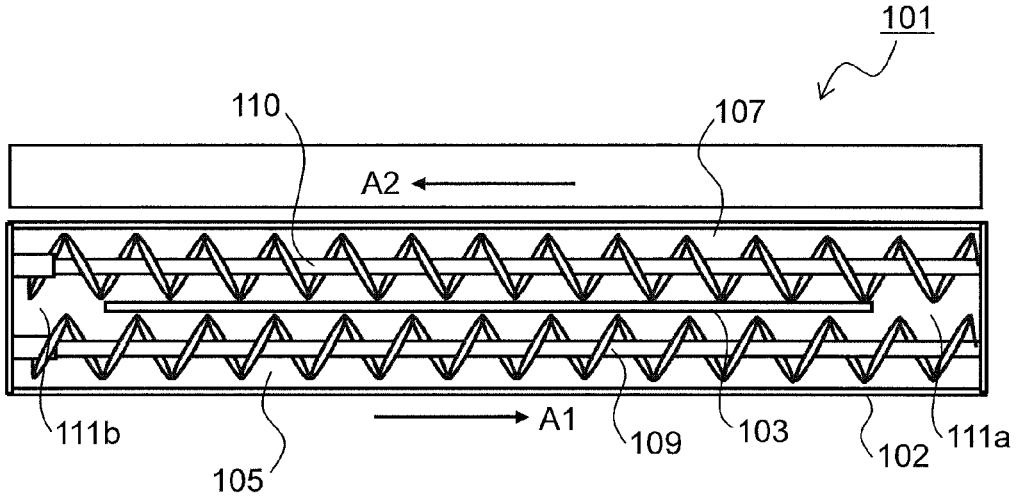
FIG.18 PRIOR ART

Then, the sensor output value (V) and the toner weight (g) in continuous printing are measured every 500 sheet printing until 8,000 sheets for Examples 1 and 2 and Comparative Example 1. Note that the A4 size paper sheets were used, a coverage rate was set to 4%, and the experiment was performed at normal temperature. Results of Examples 1 and 2 and Comparative Example 1 are shown in FIGS. 15, 16, and 17, respectively.

Figure 15:
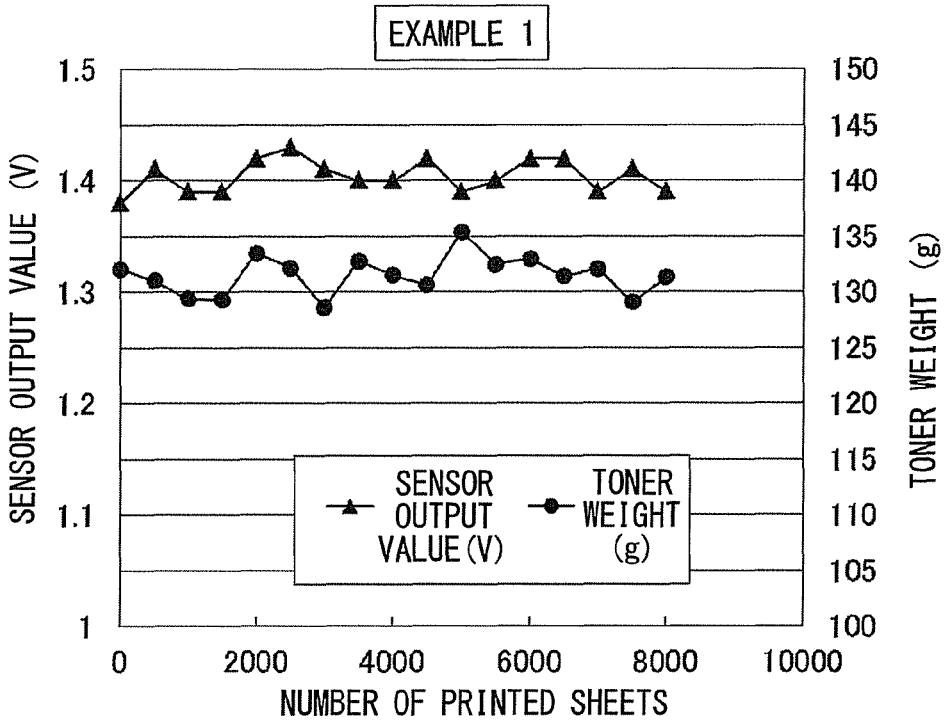
FIG. 15 is a graph showing a result of measuring a sensor output value (V) and toner weight (g) every 500 sheet printing when continuous printing is performed using the developing device of Example 1.

In Example 1, as illustrated in FIG. 15, the toner weight was 128.6 g to 135.4 g, and a variation range of the toner weight was 6.8 g. In Example 2, as illustrated in FIG. 16, the toner weight was 129.1 g to 132.5 g, and the variation range of the toner weight was 3.4 g. In Comparative Example 1, as illustrated in FIG. 17, the toner weight was 115.7 g to 132.2 g, and the variation range of the toner weight was 16.5 g. In other words, in Example 1, the variation range of the toner weight was decreased to approximately 41% compared with Comparative Example 1. In Example 2, the variation range of the toner weight was decreased to approximately 21% compared with Comparative Example 1. Note that in Comparative Example 1, a white void was generated in a printed image after printing approximately 3,000 sheets.

As described above it was confirmed that it was possible to prevent the developer (toner) from being pressed by a pressure and being falsely detected by the toner sensor 43 by setting the ceiling height of the part of the first transport path 40*a* facing the first developer delivery portion 40*d* to be larger than the ceiling height of other part of the first transport path 40*a*.

In addition, it was confirmed that it was possible to circulate the developer (toner) through the space between the first ribs 51*a* and 51*b*, to suppress adhesion of the developer to the first ribs 51*a* and 51*b*, and to improve control accuracy of toner supply by using the first spiral 31 equipped with the paddle portion 50.

Note that the embodiments describe above are examples in every aspect and should not be interpreted as limitations. The scope of the present disclosure is defined not by the above description of the embodiments but by the claims, which includes every modification within the meanings and ranges equivalent to the claims.

For instance, in the embodiment described above, the present disclosure can be applied not only to the monochrome printer illustrated in FIG. 1 but also various image forming apparatuses such as a digital or analog monochrome copier, color printer, color copier, or facsimile equipped with the developing device including the first agitating and mixing member and the second agitating and mixing member.

In addition, in the second and third embodiments described above, the paddle portion 50 of the first spiral 31 includes the pair of first ribs 51*a* and 51*b* at positions opposed to each other with respect to the center line of the rotation shaft 31*a*. However, in the large first spiral 31 having a relatively large outer diameter of the first helical blade 31*b*, the paddle portion 50 may have three or more first ribs. In this case, it is preferred to dispose the first ribs at constant intervals around the center line of the rotation shaft 31*a*.

In addition, in the embodiments described above, there are used the first spiral 31 and the second spiral 32, in which the helical blades 31*b* and 32*b* are continuously formed around the rotation shafts 31*a* and 32*a*. However, without limiting to the helical blades 31*b* and 32*b*, it is possible to use an agitating feeding member, for example, in which a plurality of semi-lunar plates (half-circular plates) are formed around the rotation shaft 31*a* or 32*a* alternately at a predetermined inclined angle.

In addition, in the embodiments described above, there is described an example in which the developer is the one-component developer containing only the magnetic toner. However, the present disclosure is not limited to this. It is possible to use two-component developer containing magnetic carrier and toner as the developer. Note that in the two-component developing method using the two-component developer, as the toner amount becomes smaller in the developing device 4, a ratio of the magnetic carrier becomes larger. Therefore, the output value of the toner sensor 43 becomes larger.

What is claimed is:

1. A developing device comprising:

a developing container having a first transport path and a second transport path disposed substantially in parallel to each other, so as to store a developer containing toner;

a developer carrier supported in the developing container in a rotatable manner so as to carry the developer in the second transport path on a surface thereof;

a first agitating feeding member configured to agitate and feed the developer in the first transport path;

a second agitating feeding member configured to agitate and feed the developer in the second transport path to the opposite direction to the first agitating feeding member;

a first developer delivery portion configured to deliver the developer from the first transport path to the second transport path;

a second developer delivery portion configured to deliver the developer from the second transport path to the first transport path; and a toner sensor disposed at a part of the first transport path close to the first developer delivery portion so as to detect toner amount or toner density in the developing container, wherein a ceiling height of a part of the first transport path facing the first developer delivery portion is larger than a ceiling height of other parts of the first transport path;

the first agitating feeding member includes a rotation shaft and a transporting blade formed around an outer circumference surface of the rotation shaft, and a part of the first agitating feeding member facing the first developer delivery portion does not have the rotation shaft and has a paddle portion including a plurality of first ribs parallel to the rotation shaft.

2. The developing device according to claim 1, wherein the paddle portion has a frame-like shape including the transporting blade positioned at a most downstream side in a developer transport direction and the plurality of first ribs extending in parallel to the rotation shaft from the transporting blade.

3. The developing device according to claim 2, wherein the paddle portion has a frame-like shape surrounded by the transporting blade positioned at the most downstream side in the developer transport direction, two first ribs extending in parallel to the rotation shaft from the transporting blade, and a second rib extending perpendicularly to the rotation shaft so as to connect ends of the first ribs, and the second rib is connected to the rotation shaft at the opposite surface to the surface connected to the first ribs.

4. The developing device according to claim 2, wherein the transporting blade on the most downstream side in the developer transport direction constituting the paddle portion is formed so that at least a part thereof is overlapped with the first developer delivery portion in the rotation shaft direction.

5. The developing device according to claim 1, wherein the first rib of the paddle portion is provided with a developer breaking member for breaking a developer wall formed in the first developer delivery portion.

6. The developing device according to claim 5, wherein the developer breaking member protrudes outside in the radial direction from a rotation locus of the transporting blade of the first agitating feeding member.

7. The developing device according to claim 5, wherein the developer breaking member is provided to each of the plurality of first ribs at different positions in the rotation shaft direction.

8. The developing device according to claim 5, wherein the developer breaking member is disposed at a position such as not to contact with a detection surface of the toner sensor.

9. An image forming apparatus comprising the developing device according to claim 1.

* * * * *